US005462338A

United States Patent [19]

Baumann

[11] Patent Number: 5,462,338

[45] Date of Patent: Oct. 31, 1995

[54] ADJUSTABLE ARM CONTROL

[75] Inventor: Stephen J. Baumann, Green Bay, Wis.

[73] Assignee: Krueger International, Inc., Green Bay, Wis.

[21] Appl. No.: 222,467

[22] Filed: Apr. 1, 1994

[51] Int. Cl.[6] ..... A47C 7/54

[52] U.S. Cl. ..... 297/411.37; 297/383; 403/109; 403/322

[58] Field of Search ..... 297/383, 411.36, 297/411.37; 248/298; 403/109, 322

[56] References Cited

U.S. PATENT DOCUMENTS

| | | | |
|---|---|---|---|
| 413,156 | 10/1889 | Wilkerson . | |
| 455,168 | 6/1891 | Case . | |
| 1,955,969 | 4/1934 | Marzolf | 403/322 X |
| 2,142,454 | 1/1939 | Needham | 403/322 X |
| 3,586,374 | 6/1971 | Laessker . | |
| 4,085,967 | 4/1978 | Spencer . | |
| 4,536,031 | 8/1985 | Latone | 297/383 X |
| 4,884,846 | 12/1989 | Tobler . | |
| 5,338,133 | 8/1994 | Tornero | 297/411.37 X |

FOREIGN PATENT DOCUMENTS

| | | | |
|---|---|---|---|
| 11707 | 10/1990 | WIPO | 297/383 |

*Primary Examiner*—Peter R. Brown

*Attorney, Agent, or Firm*—Andrus, Sceales, Starke & Sawall

[57] ABSTRACT

A mechanism for adjusting the position of an armrest relative to a seat includes a support member having the armrest mounted on a first end thereof and a locking track mounted on a second end thereof. A mounting plate assembly is fixed to the seat for slidably receiving the support member and the locking track. A leveraged clamping linkage is movably mounted to the mounting plate assembly and is selectively engageable and disengageable between the locking track and the mounting plate assembly for permitting independent adjustment of the support member and armrest in various positions relative to the seat.

15 Claims, 2 Drawing Sheets

ADJUSTABLE ARM CONTROL

TECHNICAL FIELD

This invention relates generally to an adjustment mechanism for a chair or the like and, more particularly, pertains to an adjustment mechanism for changing the position of an armrest relative to the seat of the chair.

BACKGROUND OF THE INVENTION

With the realization that chairs should be useful for persons of widely differing sizes and shapes, various attempts have been made to provide releasable locking arrangements operable to maintain an armrest in a desired position with respect to its seat in either lateral or vertical directions.

One example of such an adjustment arrangement is shown in U.S. Pat. No. 4,085,967 issued Apr. 25, 1978 to Spencer, wherein a stool including an armrest is mounted via a pair of upright supports to bearing sleeves in a bearing bracket. Short rods are fixed to the upper ends of supports and a position-maintaining unit is interposed between the rods and the armrest. The position-maintaining unit includes an actuating lever which is manually actuable for selectively enabling an operator to adjust the angle and fix supports in a desired predetermined position via a clutch arrangement to fix the front-rear position of the armrest.

In U.S. Pat. No. 455,168 issued Jun. 30, 1891 to Case, a transverse horizontal adjustment mechanism includes a channel which receives horizontal portions of arm supports or standards for sidearms. Each horizontal portion includes a rectangular slot having a series of gear teeth at one edge which constantly engages a rotary pinion extending into the channel. Adjustment of the lateral position of the sidearms is accomplished by exerting a manual force either inwardly or outwardly on one of the arms, which is transferred through the pinion to the other arm to simultaneously move both arms inwardly or outwardly.

In U.S. Pat. No. 4,884,846 issued Dec. 5, 1989 to Tobler, a horizontal arm adjustment system includes a horizontally extending support portion pivotally connected to a cross-support element which in turn is secured to the seat. To adjust the spacing between armrests, the user first loosens the support braces from one of the screw holes, repositions the support braces as desired to the other holes, and then reattaches the braces.

In U.S. Pat. No. 3,586,374 issued Jun. 22, 1971 to Laessker, there is disclosed a system for horizontally adjusting the armrests which is mounted to a first sleeve which is, in turn, received within a second sleeve having a series of internal detents. An actuator rod extends through the first sleeve for selectively moving a ball into and out of engagement with the detents upon inward and outward movement of a rod. A spring biases the rod outwardly for forcing the ball into engagement with one of the detents.

In U.S. Pat. No. 413,156 issued Oct. 15, 1889 to Wilkerson, a dental chair includes a horizontal adjustment system in the form of a slot formed in the portion of an arm mounting bracket extending under the seat and a set screw having a handle extending through the slot for selectively adjusting the horizontal position of the arm.

Notwithstanding these previous designs, it remains desirable to provide a leveraged clamping adjustment mechanism of a different type from that shown in the aforementioned prior art which is easily adjusted, positively locked, quickly released, and virtually maintenance free. It is also highly desirable that such adjustment mechanism is economical to manufacture and easy to assemble.

SUMMARY OF THE INVENTION

The adjustment mechanism of the present invention advantageously provides a safe, effective structure for providing variable positioning of an armrest relative to a seat. The adjustment mechanism has a unique construction designed for strength, durability and maintenance of the desired adjusted positions.

These and other aspects of the invention are realized in a mechanism for adjusting the position of an armrest relative to a seat. The mechanism comprises a support member having the armrest mounted on a first end thereof and a locking track secured on the second end thereof. A mounting plate assembly is fixed to the seat for slidably receiving the support member and the locking track. A leveraged clamping linkage is movably secured to the mounting plate assembly and is selectively engageable and disengageable between the locking track and the mounting plate assembly for permitting independent adjustment of the support member on the armrest and various positions relative to the seat.

In another aspect of the invention, the mechanism comprises a tubular support member having the armrest mounted on a first end thereof and a notch-like locking track secured on a second end thereof. A stirrup-shaped mounting plate assembly is fixed to the seat for slidably receiving the support member and the locking track therein. The mounting plate assembly includes a pair of parallel, spaced apart side plates, each of the side plates being formed with a locating slot therein. A leveraged clamping linkage is movably mounted on the mounting plate assembly and includes a locking pin extending across the mounting plate assembly. The pin is selectively shiftable in the locating slots and into and out of the locking track to enable adjustment of the support member and the armrest in various positions relative to the seat.

In a highly preferred embodiment, the invention contemplates a mechanism comprising a generally L-shaped, tubular support member having the armrest fixably mounted on an upper end thereof and a notch-like locking track fixedly secured on a lower end thereof. A stirrup-shaped mounting plate assembly is fixed to the seat for slidably receiving the support member and the locking track therein. The mounting plate assembly includes a pair of parallel, spaced apart side plates, each of the side plates being formed with a locating slot therein and a first bearing assembly extending across and joining the side plates. A clamping linkage is movably mounted on the mounting plate assembly and includes a pair of parallel, spaced apart links lying adjacent the side plates, a locking pin extending across and joining the links at one end thereof, a second bearing assembly extending across and connecting the links at a second end thereof and an over-center lever disposed for pivotal movement between the first bearing assembly and the second bearing assembly. The lever is movable from a position maintaining setting wherein the locking pin is engageable with the locking track and the second bearing assembly lies on one side of a transverse axis passing through the centers of the locking pin and the first bearing assembly to a position releasing setting wherein the locking pin is disengageable from the locking track and said second bearing assembly lies on the other side of the transverse axis passing through the centers of the locking pin and the first bearing assembly to enable selective adjustment of the armrest relative to the seat.

BRIEF DESCRIPTION OF THE DRAWINGS

The invention will become better understood by reference to the following detailed description of the preferred exemplary embodiment when read in conjunction with the appended drawing, wherein like numerals denote like elements and:

FIG. 1 is a plan view of a mechanism for adjusting the position of an armrest relative to the seat of a chair or the like;

DETAILED DESCRIPTION OF THE PREFERRED EMBODIMENT

Figure 1:
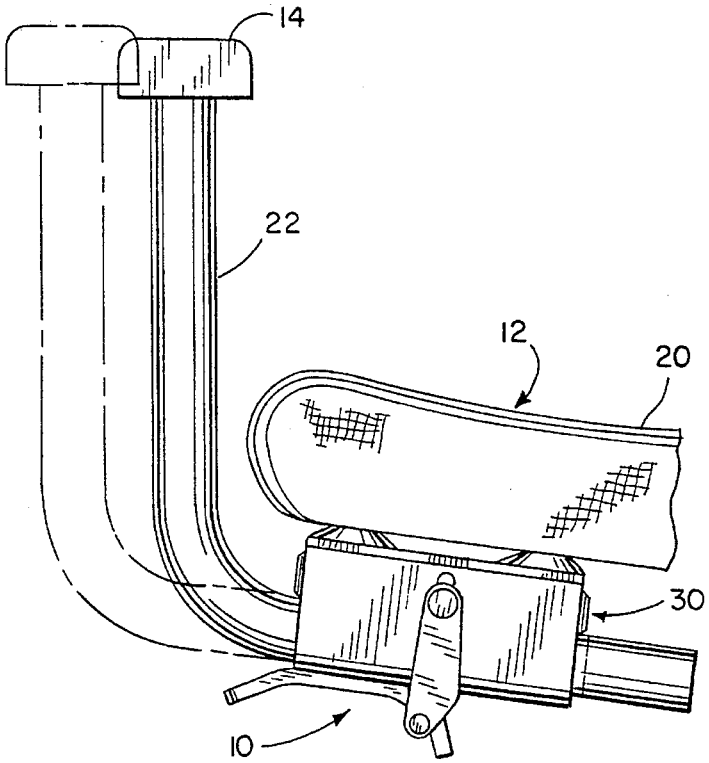

Referring now to FIGS. 1–4, an adjustment mechanism 10 embodying the present invention is applied to a chair or the like having a seat 12 and at least one armrest 14. In accordance with the present invention, the level of armrest 14, in the region where it is engaged by the user, is adjustable with respect to seat 12 primarily in a horizontal plane and, to some degree, in a vertical plane.

Armrest 14 may be of any suitable shape and is preferably padded or covered with decorative or protective material. In similar fashion, seat 12 includes a seat board 16 typically padded with a foam cushion 18 and protected by a fabric, leather or vinyl covering 20. Armrest 14 is mounted to an upper end of a rigid, tubular support member 22 which is typically elliptical or ovoid in cross section. A nylon locking track 24 having a series of position-defining notches 26 is secured to the upper portion of support member 22 at a lower end thereof. Notches 26 are formed by opposing ramps 28, each of which are oriented at substantially 30° with respect to the longitudinal axis of the lower end of support member 22.

Figure 4:
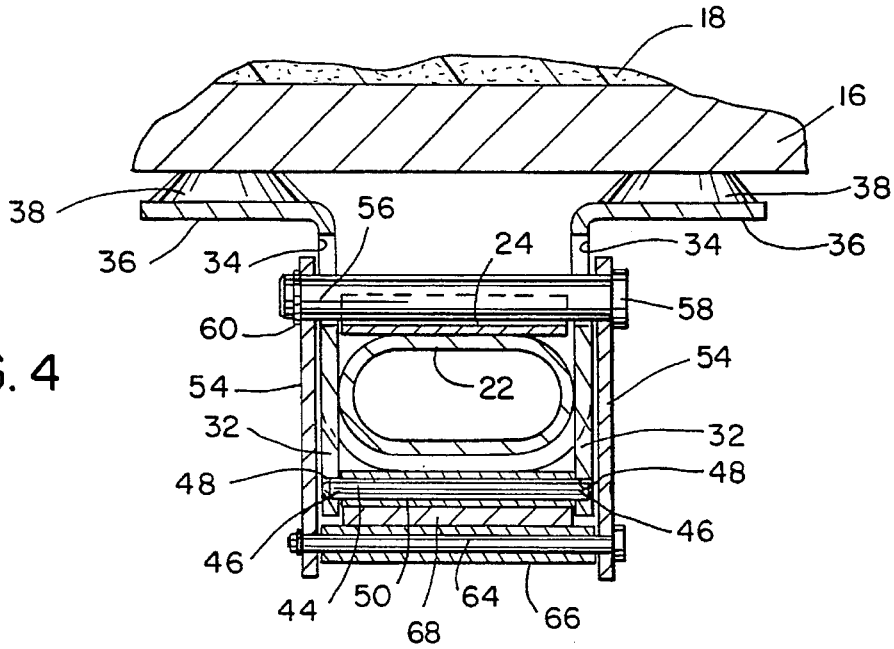
FIG. 4 is a cross-sectional view taken on line 4—4 of FIG. 2.

A stirrup-shaped mounting plate assembly 30 is secured by fasteners 31 to the bottom of seat board 16 and functions to slidably receive support member 22 and locking track 24 therein. As best seen in FIG. 4, mounting plate assembly 30 comprises a pair of parallel, spaced apart side plates 32, each of which is formed with a locating sloe 34 therein. Side plates 32 also have upper winged portions 36 with frustoconical caps 38 for spacing winged portions 36 from seat board 16. Extending across and joining depending portions 40 of side plate 32 aligned with locating slots 34 is a first bearing assembly 42 which underlies support member 22. Bearing assembly 42 includes a retaining pin 44 having ends 46 which are seated in respective apertures 48 formed in depending portions 40 of side plates 32 and a bearing sleeve 50 rotatably mounted on retaining pin 44.

As a salient feature of the invention, a leveraged clamping linkage 52 is movably mounted on mounting plate assembly 30. Linkage 52 includes a pair of parallel, spaced apart links 54 lying exteriorly of and adjacent side plates 32. A locking pin 56 extends across and joins links 54 at an upper end thereof. Pin 56 has a head 58 disposed to the outside of one link 54 and a retainer 60 fixed on the other end of pin 56 to the outside of the other link 54 to maintain pin 56 in place for selective engagement and disengagement with locking track 24 as will be described. A second bearing assembly 62 having a retaining pin 64 smaller in size but similar in structure to locking pin 56 and a bearing sleeve 66 rotatably mounted thereon extends across and joins links 54 along a lower end thereof. An over-center lever 68 is welded at 70, or otherwise mounted, to bearing sleeve 50 and disposed for pivotal movement between first bearing assembly 42 and second bearing assembly 62.

Figure 2:
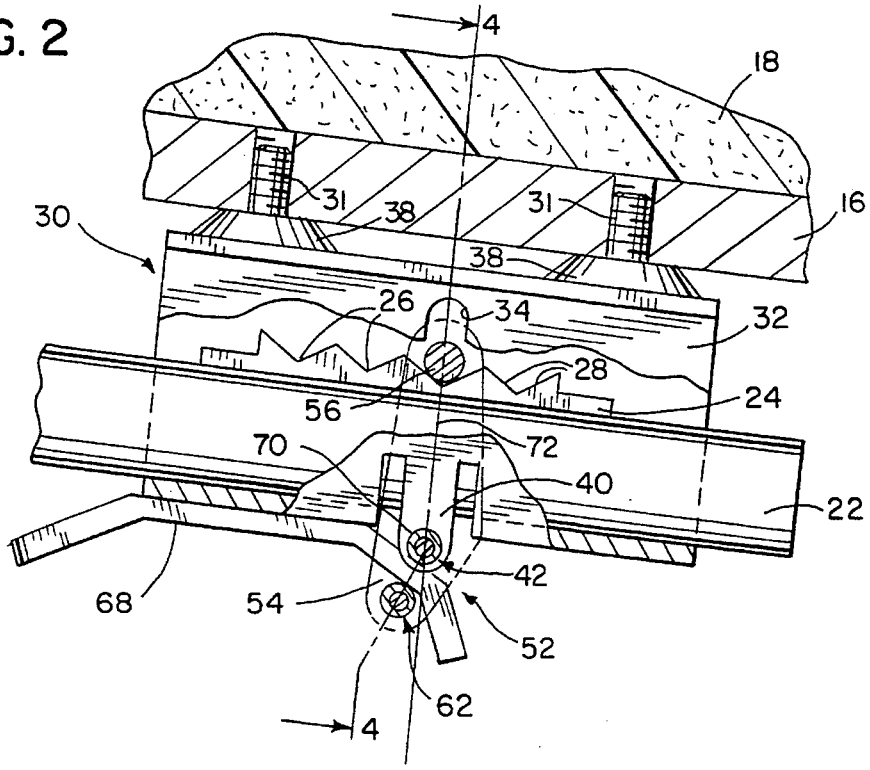
FIG. 2 is an enlarged, fragmentary view in partial cross section showing the adjustment mechanism in a position retaining setting.
Figure 3:
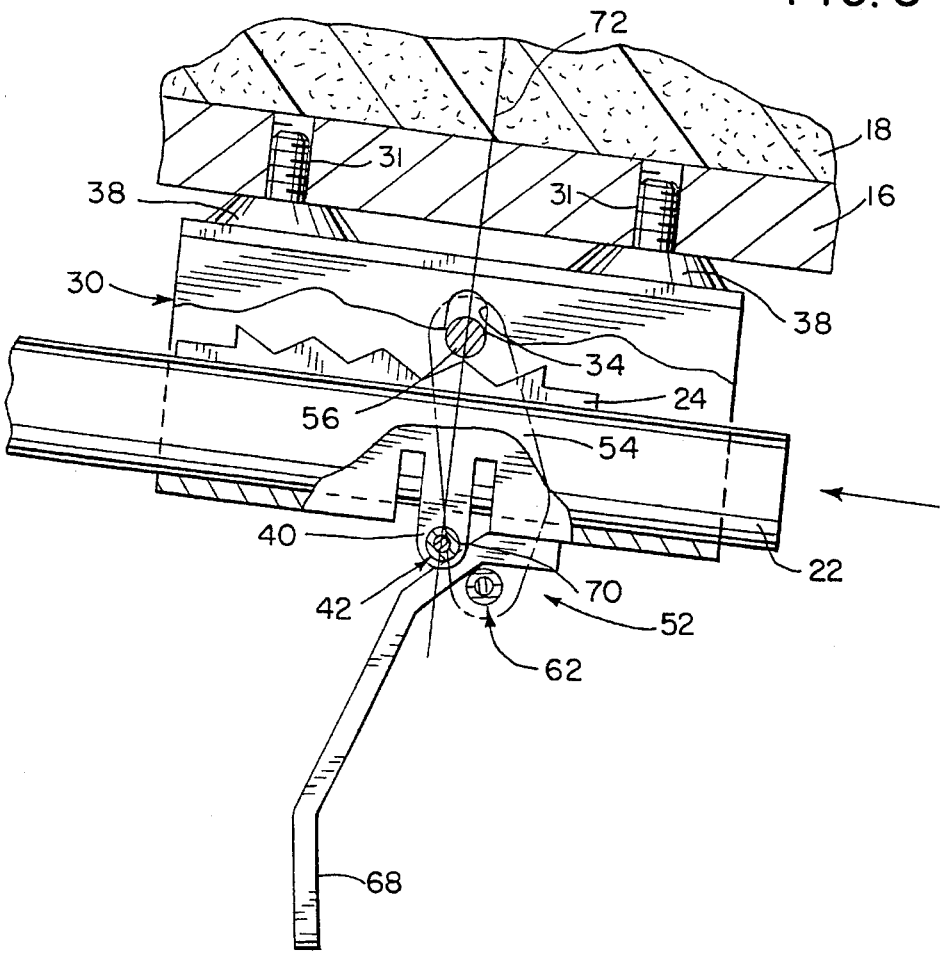
FIG. 3 is a view similar to FIG. 2 showing the adjustment mechanism in a position releasing setting.

In use, lever 68 is movable from a position maintaining setting depicted in FIG. 2 to a position releasing setting illustrated in FIG. 3 wherein armrest 14 is moved away from seat 12 in the direction shown by the arrow. In the position maintaining setting, locking pin 56 is positively engaged in one of the notches 26 in locking track 24 and second bearing assembly 62 lies on one side of a transverse axis 72 passing through the centers of locking pin 56 and first bearing assembly 42. When it is desired to adjust the position of armrest 14, lever 68 is rotated about first bearing assembly 42, shifting linkage 52 such that locking pin 56 is moved upwardly to the position releasing setting along locating slots 34 and out of notch 26 of locking track 24 such that second bearing assembly 62 lies on the other side of transverse axis 72. Such motion frees the clamping engagement between support member 22 and mounting plate assembly 30 to enable the desired sliding adjustment of armrest 14 relative to seat 12. As shown in phantom lines of FIG. 1, the primary adjustment occurs in a horizontal plane along with a degree of adjustment in a vertical plane dependent upon the shape and length of support member 22. Once adjustment of armrest 14 has been made, lever 68 is rotated back to its original position maintaining setting.

It should be appreciated that the present invention improves the adjustment of armrest 14 with respect to seat 12 through the use of a unique leveraged clamping linkage 52 which provides smooth, positive locking and unlocking. Adjustment mechanism 10 is relatively simple in construction yet is durable, virtually maintenance free and safe for all operators. Unlike prior art adjustment mechanisms, the present invention requires no clutch arrangements, spring detents, support arm disassembly or pinions.

While the invention has been described with reference to a preferred embodiment, those skilled in the art will appreciate that certain substitutions, alternations and omissions may be made without departing from the spirit thereof. For example, locking track 24 could be made unitary with support member 22 to simplify construction. In addition, locking track 24 may be variously configured with the desired shape and number of notches 26. Accordingly, the foregoing description is meant to be exemplary only and should not be deemed limitative on the scope of the invention set forth in the accompanying claims.

I claim:

1. In combination, a seat, an armrest mounted thereto, and a mechanism for adjusting the armrest relative to the seat, the mechanism comprising:

a support member having the armrest mounted on a first end thereof and locking track secured on a second end thereof;

a mounting plate assembly fixed to the seat for slidably receiving said support member and said locking track, said mounting plate assembly having a first bearing assembly; and a leveraged clamping linkage movably secured to said mounting plate assembly and including a pair of shiftable links interconnected by a locking pin which is selectively engageable and disengageable between said locking track and said mounting plate assembly for permitting independent adjustment of said support member and the armrest in various positions relative to the seat and allowing removal of said support member and said armrest relative to the seat, said clamping linkage further comprising a second bearing assembly connecting said links, and an over the center lever disposed between said first bearing assembly and said second bearing assembly for pivotal movement about said first bearing assembly to shift said links and move said locking pin upwardly and downwardly with respect to said locking track.

2. The mechanism according to claim 1, wherein said support member is substantially elliptical in cross section.

3. The mechanism according to claim 1, wherein said mounting plate assembly and said leveraged clamping linkage are positioned beneath the seat.

4. The mechanism according to claim 1, wherein said locking track is comprised of nylon.

5. In combination, a seat, an armrest mounted thereto, and a mechanism for adjusting the armrest relative to the seat, the mechanism comprising:

a support member having the armrest mounted on a first end thereof and a locking track secured on a second end thereof;

a mounting plate assembly fixed to the seat for slidably receiving said support member and said locking track, said mounting plate assembly having a first bearing assembly; and a leveraged clamping linkage movably secured to said mounting plate assembly and including a pair of shiftable links interconnected by a locking pin which is selectively engageable and disengageable between said locking track and said mounting plate assembly for permitting independent adjustment of said support member and the armrest in various positions relative to the seat and allowing removal of said support member and said armrest relative to the seat, wherein said locking track is comprised of a series of opposing ramps, each of which is oriented substantially 30° with respect to a longitudinal axis of said support member and is individually engageable with said locking pin, said clamping linkage further comprising a second bearing assembly connecting said links, and an over the center lever disposed between said first bearing assembly and said second bearing assembly for pivotal movement about said first bearing assembly to shift said links and move said locking pin upwardly and downwardly with respect to said ramps.

6. In combination, a seat, an armrest mounted thereto, and a mechanism for adjusting the armrest relative to the seat, the mechanism comprising:

a tubular support member having the armrest mounted on a first end thereof and a notch-like locking track secured on a second end thereof;

a stirrup-shaped mounting plate assembly fixed to the seat for slidably receiving said support member and said locking track therein, said mounting plate assembly including a depending bearing portion and a pair of parallel, spaced apart side plates, each of said side plates being formed with a locating slot therein; and a leveraged clamping linkage pivotably mounted about said depending bearing portion and including a pair of spaced apart shiftable links connected by a locking pin extending across said mounting plate assembly and being selectively shiftable in said locating slots and into and out of said locking track to enable adjustment of said support member and the armrest in various positions relative to the seat, said clamping linkage further comprising a lever positioned between said side plates and said links, and operably connected with said links, and pryable directly against said depending bearing portion to shift said links and move said locking pin upwardly and downwardly with respect to said locking track thereby obtaining a sustained position releasing setting.

7. In combination, a seat, an armrest mounted thereto and a mechanism for adjusting the armrest relative to the seat, the mechanism comprising:

a generally L-shaped, tubular support member having the armrest mounted on an upper end thereof and a notch-like locking track fixedly secured on a lower end thereof;

a stirrup-shaped mounting plate assembly fixed to the seat for slidably receiving said support member and said locking track therein, said mounting plate assembly including a pair of parallel, spaced apart side plates, each of said side plates being formed with a locating slot therein, and a first bearing assembly extending across and joining said side plates; and a clamping linkage movably mounted on said mounting plate assembly and including a pair of parallel, spaced apart links lying adjacent said side plate, a locking pin extending across and joining said links at one end thereof, a second bearing assembly extending across and connecting said links at a second end thereof and an over-center lever disposed between said first bearing assembly and said second bearing assembly for pivotal movement about said first bearing assembly, said lever being movable from a position maintaining setting wherein said locking pin is engageable with said locking track and said second bearing assembly lies on one side of a transverse axis passing through the centers of said locking pin and said first bearing assembly to a position releasing setting wherein said locking pin is disengageable from said locking track and said second bearing assembly lies on the other side of the transverse axis passing through the centers of said locking pin and said first bearing assembly to enable selective adjustment of the armrest relative to the seat.

8. The mechanism of claim 7, wherein said lever is mounted to said first bearing assembly.

9. The mechanism according to claim 7, wherein said first bearing assembly is located beneath said support member.

10. The mechanism according to claim 7, wherein said second bearing assembly is located below said first bearing assembly.

11. The mechanism according to claim 7, wherein said first bearing assembly comprises a first retaining pin having end portions retained in said side plates and a first bearing sleeve rotatably mounted on said first retaining pin.

12. The mechanism according to claim 7, wherein said second bearing assembly comprises a second retaining pin having end portions retained in said links and a second bearing sleeve rotatably mounted on said second retaining pin.

13. The mechanism according to claim 7, wherein said lever is disposed between said first bearing sleeve and said second bearing sleeve.

14. The mechanism of claim 7, wherein said locking pin is located above said support member.

15. The mechanism of claim 7, wherein said locking pin is seated on a bottom end of said locating slots during said position maintaining setting and is movable upwardly along said slots during said position releasing setting.

* * * * *

UNITED STATES PATENT AND TRADEMARK OFFICE

CERTIFICATE OF CORRECTION

PATENT NO. : 5,462,338

DATED : October 31, 1995

INVENTOR(S) : STEPHEN J. BAUMANN

It is certified that error appears in the above-identified patent and that said Letters Patent is hereby corrected as shown below:

Claim 1, column 4, line 58, after "and" insert -- a --; Claim 12, column 6, line 59, delete "7" and substitute therefor -- 11 --; Claim 13, column 6, line 65, delete "7" and substitute therefor -- 12 --.

Signed and Sealed this

Fourth Day of June, 1996

*Attest:*

*Attesting Officer*

BRUCE LEHMAN

*Commissioner of Patents and Trademarks*